US006949712B1

(12) United States Patent
O'Donnell

(10) Patent No.: US 6,949,712 B1
(45) Date of Patent: Sep. 27, 2005

(54) ACTUATOR

(75) Inventor: James O'Donnell, Renfrew (GB)

(73) Assignee: Honeywell International Inc., Morristown, NJ (US)

( * ) Notice: Subject to any disclaimer, the term of this patent is extended or adjusted under 35 U.S.C. 154(b) by 289 days.

(21) Appl. No.: 10/110,630

(22) PCT Filed: Oct. 12, 2000

(86) PCT No.: PCT/US00/28173

§ 371 (c)(1),
(2), (4) Date: Aug. 2, 2002

(30) Foreign Application Priority Data

Dec. 10, 1999 (GB) ..... 9923974

(51) Int. Cl.[7] ..... H01H 27/00
(52) U.S. Cl. ..... 200/43.04; 200/17 R; 200/61.62
(58) Field of Search ..... 200/43.04–43.09, 200/17 R, 61.62, 329, 11 R

(56) References Cited

U.S. PATENT DOCUMENTS 5,662,212 A * 9/1997 Wecke et al. ..... 200/43.04
5,744,767 A * 4/1998 Wecke et al. ..... 200/17 R
5,842,560 A * 12/1998 Kuki et al. ..... 200/43.05
6,013,881 A * 1/2000 Hall et al. ..... 200/43.04

FOREIGN PATENT DOCUMENTS

DE 295 10 071 U 8/1995
DE 44 32 862 C 10/1995
DE 44 36 199 C1 12/1995
DE 295 16 230 U 12/1995
DE 297 01 797 U 4/1997
DE 197 07 865 A 9/1997

OTHER PUBLICATIONS

PCT International Search Report (PCT/US 00/28173).

* cited by examiner

*Primary Examiner*—Richard K. Lee
(74) *Attorney, Agent, or Firm*—Kris T. Fredrick

(57) ABSTRACT

There is disclosed an improved actuator 215, and an operating key 100 for use in the actuator 215. Known actuators suffer from a number of problems such as limited functionality and limited radius of operation. Accordingly, the present invention provides an operating key 100 for use in an actuator 215, the operating key 100 comprising a key body 105 and a key element 110 and means to adjust an angle of inclination of the key element 110 relative to the key body 105, the adjustment means having first and second resilient biasing means 115, 120. The invention further provides an operating key 100 comprising means to at least partially rotate at least part 160 of the key element 110 around an axis extending from the key body 105. The operating key 100 is thus a "universal" key, which may be used in horizontal or vertical hinged doors, though is not limited to such use.

15 Claims, 9 Drawing Sheets

1/9
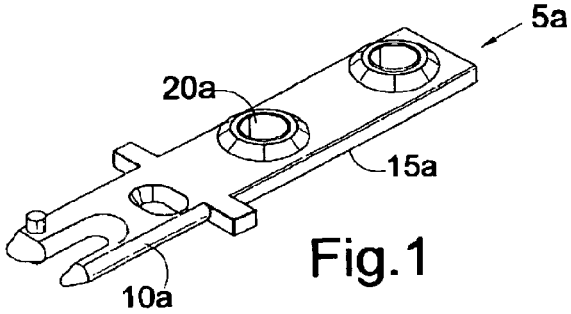
Fig.1
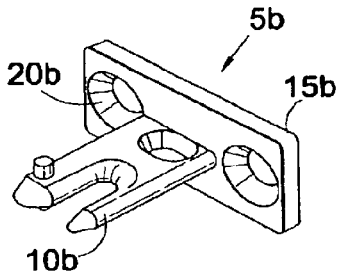
Fig.2
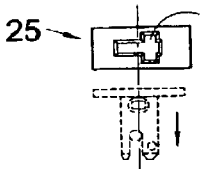
Fig.3(b)
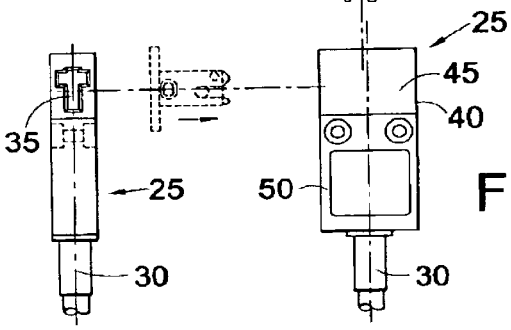
Fig.3(a)
Fig.3(c)
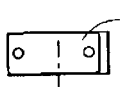
Fig.4(b)
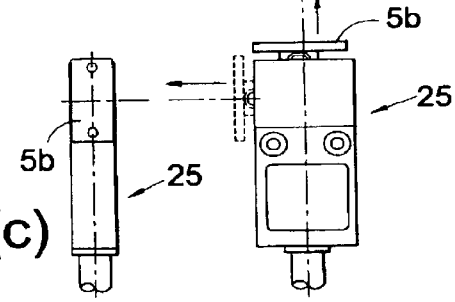
Fig.4(c)
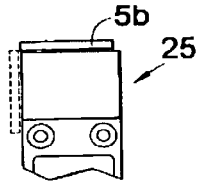
Fig.4(d)
Fig.4(a)

ACTUATOR

BACKGROUND TO THE INVENTION

This invention relates to an improved actuator, and to an operating key for use in an actuator.

Actuators comprising a switch and an operating key are known. Such switches find application in equipment such as machine guards, machine tool doors, and the like, where opening of the guard or door causes the key to be removed from the switch. This seeks to ensure that the equipment is isolated from an electrical power source such that the equipment cannot be operated while the guard or door is opened. Closing of the guard or door causes the key to be inserted into the switch thereby allowing power to be supplied to the equipment.

Normally, the switch is mounted to a body of the equipment, while the key is mounted to a moveable part of the equipment, such as a guard or door. However, the switch and the key can be swapped round if preferred.

At present, manufacturers of actuators require to provide a range of operating keys. For example, it may be required to provide a straight key for sliding guards capable of being mounted on a surface of the equipment parallel to an actuation direction. It may further be required to provide a key capable of being mounted on a surface of the equipment perpendicular to the actuation direction.

It may also be desirous to provide keys particularly for use on hinged doors or guards. For example, it is known to provide an adjustable key for horizontal radius pivoting guards as hereinafter described. It is also known to provide an adjustable key for vertical radius pivoting guards.

Known adjustable actuators are "spring loaded" by means of longitudinal banding of a coiled spring provided with the operating key.

Known actuators and operating keys provide a number of problems. For example, a manufacturer requires to make a number of keys for use in different scenarios, as mentioned above. Further a manufacturer of equipment requires to stock a number of different actuator and key types.

A further problem exists with known adjustable keys in that they are often limited to an unacceptably high operating radius, eg. of around 160 to 220 mm.

It is an object of at least one aspect of the present invention to obviate or at least mitigate one or more of the aforementioned problems in the prior art.

It is a further object of at least one embodiment of the present invention to provide a "universal" operating key, ie. one which may be used in various applications, such as, both horizontally and vertically pivoting guards.

It is a further object of at least one embodiment of the present invention to provide an operating key which allows an actuator to be used at a smaller operating radius than presently possible.

It is a yet further object of at least one embodiment of the present invention to provide an improved operating key which can be used with known and presently available switches.

SUMMARY OF THE INVENTION

According to a first aspect of the present invention there is provided an operating key for use in an actuator, the operating key comprising a key body and a key element and means to adjust an angle of inclination of the key element relative to the key body, the adjustment means having first and second resilient biasing means.

Preferably, the first and second resilient biasing means act to maintain the key element in a first position while allowing the key element to be resiliently moved to a second position relative to the key body.

In this way the key element is resiliently biased between a first "set" position and a second "operating" position.

Preferably, the first position is a preset inclined position relative to the key body, and the second position is preferably substantially perpendicular to the key body.

Preferably, the first and second resilient biasing means act against opposing sides of a portion of the key element.

Advantageously, the first and second resilient biassing means are substantially longitudinally aligned and spaced one from the other.

In a preferred embodiment the first and second resilient biasing means comprise first and second coiled springs.

Preferably; the adjustment means further comprises a leg depending from the key element.

Preferably, the leg is received between adjacent ends of the first and second resilient biasing means.

Advantageously, the adjustment means further includes means to adjust longitudinal tension of the first and second resilient biasing means.

In a preferred embodiment the first and second resilient biasing means are provided within an elongate channel in the key body.

In the preferred embodiment the adjustment means further comprises a threaded adjustment screw longitudinally retained relative to the channel but free to rotate axially relative thereto, and a plate carried on the threaded adjustment screw. Advantageously, a face of the plate is in abutting contact with an end of one of the first or second resilient biasing means.

Advantageously also, there are provided means for preventing rotation of the plate within the channel, eg. but not exclusively co-acting nipples and slots formed on the plate and in the channel, respectively.

In this way, rotation of the adjustment screw causes movement of the plate therealong thereby adjusting longitudinal tension of the first and second resilient biasing means so as to cause movement of the leg and therefore of the key element. Thus, the first "set" position may be selected by rotation of the adjustment screw.

Advantageously, the key element comprises a first body and a second body rotatably mounted on the first body.

According to a second aspect of the present invention there is provided an actuator comprising a switch and an operating key insertable into the switch, the operating key comprising a key body and a key element and means to adjust an angle of inclination of the key element relative to the key body, the adjustment means having first and second resilient biasing means.

The switch may provide a switch body having one or more apertures formed thereon, the/each aperture being adapted to receive at least part of the key element.

According to a third aspect of the present invention there is provided an apparatus including at least one actuator, the at least one actuator comprising a switch and an operating key insertable into the switch, the operating key comprising a key body and a key element and means to adjust an angle of inclination of the key element relative to the key body, the adjustment means having first and second resilient biasing means.

The apparatus may include a door and preferably a hinged door, one of the switch and operating key being mounted on a body of the apparatus and the other being mounted on the door.

Preferably, the switch is mounted on the apparatus body and the operating key is mounted on the door.

Advantageously, the key element is received into the/one of the apertures, in use.

According to a fourth aspect of the present invention there is provided an operating key for use in an actuator, the operating key comprising a key body and a key element and means to at least partially rotate at least part of the key element around an axis extending from the key body.

Preferably, the axis extends substantially perpendicularly from the key body, and preferably substantially in a direction of insertion of the operating key into a switch of the actuator.

Preferably, the rotation means are adapted to allow 360° rotation of the key element relative to the axis in at least one direction of rotation and preferably both directions of rotation.

Advantageously, the key element comprises a first body and a second body rotatably mounted on the first body.

The second body may include a key portion at least partially insertable into a switch of the actuator.

Preferably, the first body is fixed relative to the axis. However, preferably also the first body may comprise a swivel housing which may be partially rotated relative to an axis parallel to a base of the key body.

In a preferred embodiment the rotation means comprise interengaging means such as teeth or V-grooves formed in facing surface of the first and second bodies.

Advantageously, the interengaging means define 4 positions in which the first and second bodies may be located relative to one another. In this way the first body may be rotated relative to the second body by 90° increments.

Preferably, the first and second bodies are urged together by key element resilient biasing means.

Preferably, the key element resilient biasing means are provided between facing surfaces of the second body and the key body. In use, the second body may be depressed by a user against a biasing force of the key element biasing means thereby disengaging the interengaging means on the first and second bodies. The first and second bodies may then be rotated relative to one another from one set position to another set position. The user may then cease depression of the second body thereby engaging the engaging means.

According to a fifth aspect of the present invention there is provided an actuator comprising a switch and an operating key insertable into the switch, the operating key comprising a key body and a key element and means to at least partially rotate at least part of the key element around an axis extending from the key body.

According to a sixth aspect of the present invention there is provided an apparatus including at least one actuator, the at least one actuator comprising a switch and an operating key insertable into the switch, the operating key comprising a key body and a key element and means to at least partially rotate at least part of the key element around an axis extending from the key body.

BRIEF DESCRIPTION OF THE DRAWINGS

An embodiment of the present invention will now be described. by way of example only, with reference to the accompanying drawings, which are:

FIG. 1 a perspective view of a first operating key according to the prior art;

FIG. 2 a perspective view of a second operating key according to the prior art;

FIGS. 3*a*–3*c* a side view, an end view and an edge view, respectively, of a known switch for use in an actuator according to the prior art or an actuator according to the present invention;

FIGS. 4*a*–4*d* a side view, an end view, an edge view and a partial side view, respectively, of the switch of FIGS. 3*a*–3*c* having a operating key according to FIG. 2 inserted therein;

DETAILED DESCRIPTION

Figure 5A:
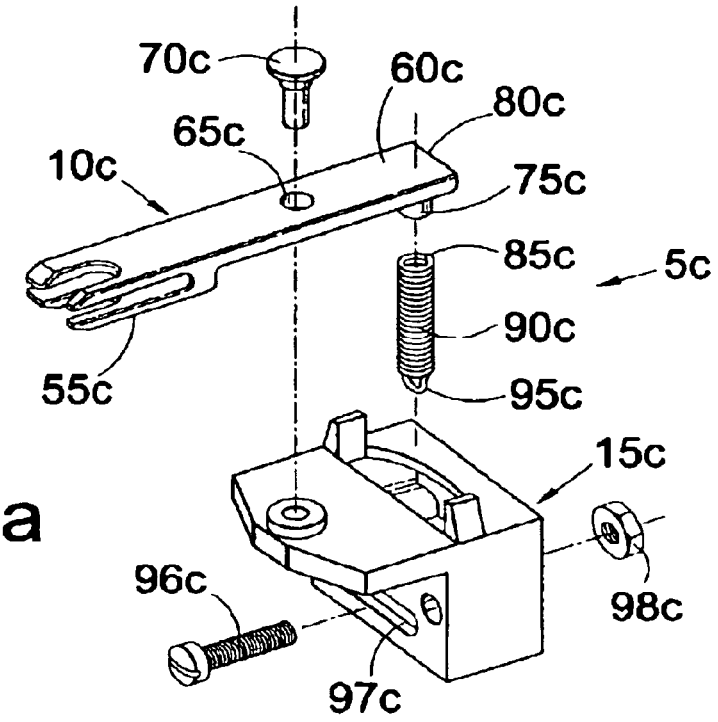
FIGS. 5*a* and 5*b* exploded perspective views of first and second adjustable operating keys according to the prior art.

Referring initially to FIG. 1 there is illustrated a first operating key, generally designated 5*a* , according to the prior art. The operating key 5*a* is of a "straight" type for sliding guards, the key 5*a* having a key portion 10*a* capable of being inserted into a switch, and a mounting portion 15*a* capable of being mounted on a surface of an apparatus parallel to an actuation direction by means of screw(s) or the like passing through one or more apertures 20*a* formed in the mounting portion 15*a*.

Referring now to FIG. 2 there is illustrated a second operating key generally designated 5*b*, typically known as an "90°" key also for use in sliding guards, the operating key 5*b* being capable of being mounted on a surface of an apparatus perpendicular to an actuation direction. The key 5*b* comprises a key portion 10*b* capable of being inserted into a switch comprising part of an actuator, and further a mounting portion 15*b* having one or more apertures 20*b* so as to allow the operating key 5*b* to be mounted on a surface perpendicular to a direction of insertion of the key portion 10*b*.

Referring now to FIGS. 3A–3C there is illustrated a switch, generally designated 25, for use with one of the operating keys 5*a*, 5*b*, the switch 25 being of a type known in the prior art. The switch 25 has an output cable 30 or connector and has first and second apertures 30, 35 provided on an end and on a edge of a switch body 40. As illustrated in FIGS. 4*a*–4*d* an operating key 5*b* (or alternatively 5*a*) can be received into either of the apertures 30 or 35. The disconnect force required to remove the operating key 5*b* (or alternatively 5*a*) from either of the apertures 30, or 35 is typically of the order of 20 Newtons maximum. The operating keys 5*a*, 5*b* are typically made from stainless steel while the switch body 40 may have a first portion 45 made from glass filled polyester, and a second portion 50 made from glass filled polyamide.

The switch 25 shown in FIGS. 3*a*–3*c* may be used with an operating key according to the present invention which will hereinafter be described. The switch 25 is available from the Applicant, and is known as a Global Key operated Miniature Switch (CKM Switch).

Referring now to FIG. 5*a*, there is shown a first adjustable key, generally designated 5*c*, for horizontal radius pivoting guards as known from the prior art. The key 5*c* comprises a key body 15*c* and a key element 10*c*. The key element 10*c* comprises an key portion 55*c* receivable within a switch (not shown) , and an elongate portion 60*c* having an aperture 65*c* through which is passed a pin 70*c* by which the key element 10*c* is pivotally joined to the key body 15*c*. A nipple 75*c* depends downwardly from a distal end 80*c* of the elongate portion 60*c*, which nipple 75*c* is received within an open end 85*c* of a coiled spring 90*c* provided within the key body 15*c*. A further end of the spring 90*c* is provided with a looped portion 95*c* through which an adjustment screw 96*c* is passed. The screw 96*c* passes through the body 15*c* via an elongated slot 97*c* in the body 15*c* and is retained by a nut 98*c*.

Figure 5B:
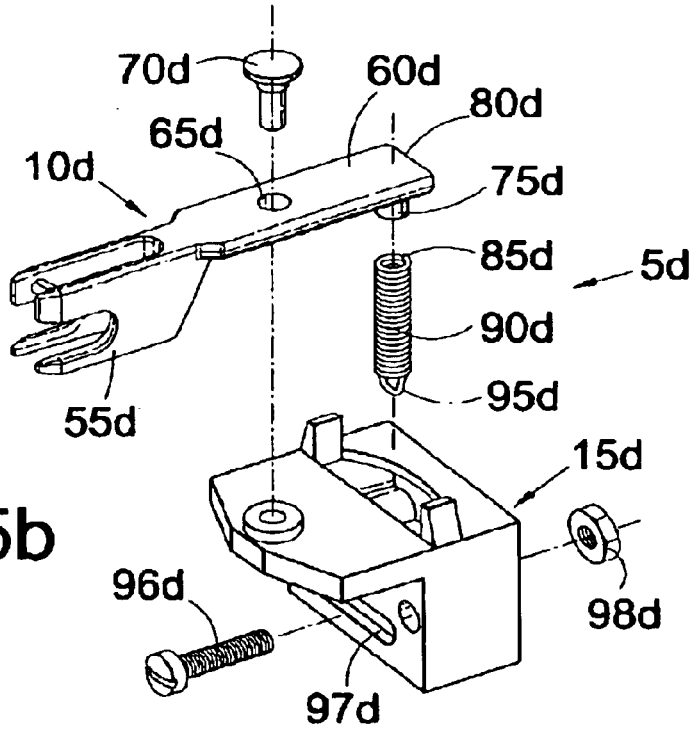
Figure 6:
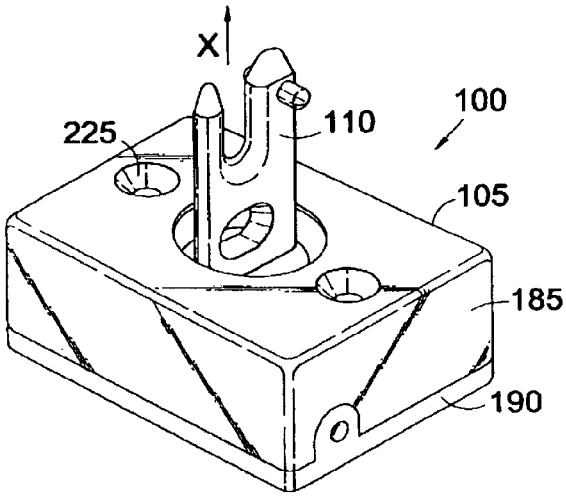
FIG. 6 a perspective view of an operating key according to an embodiment of the present invention.
Figure 7A:
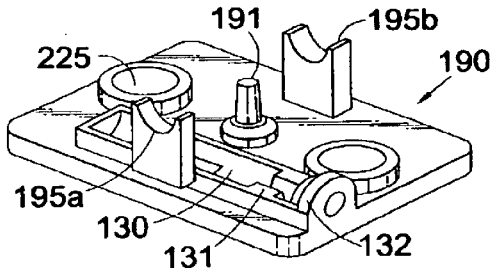
FIGS. 7*a*–7*c* a perspective view, a top view and a sectional side view, respectively, of a base portion of a key body forming part of the operating key of FIG. 6.
Figure 7B:
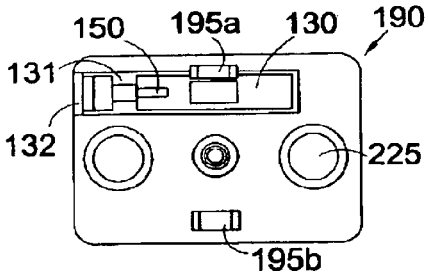
Figure 7C:
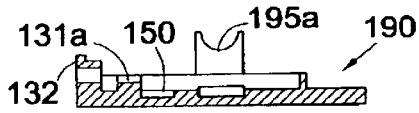
Figure 8A:
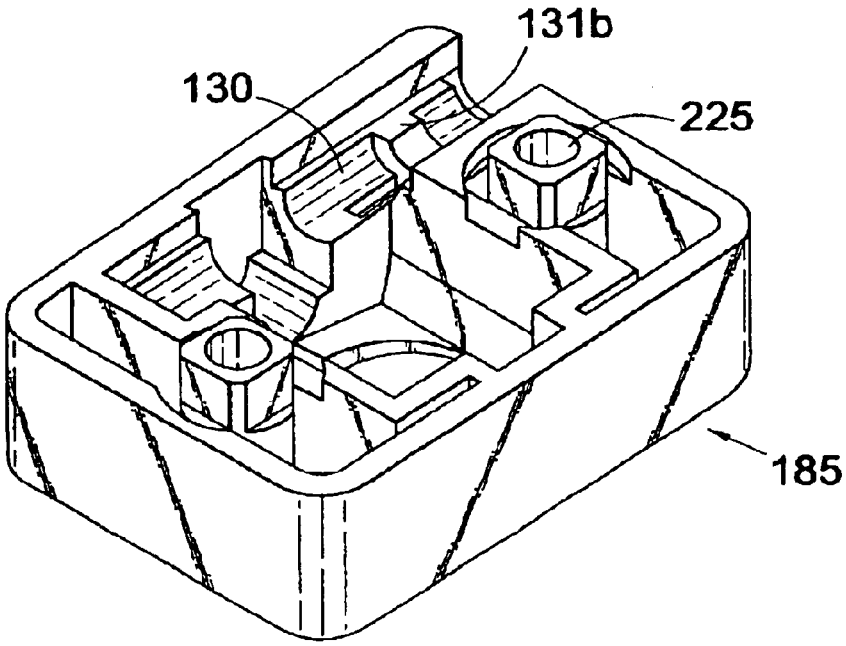
FIGS. 8*a* and 8*b* a perspective view from below and a base view, respectively, of a top portion of a key housing forming part of the operating key of FIG. 6.
Figure 8B:
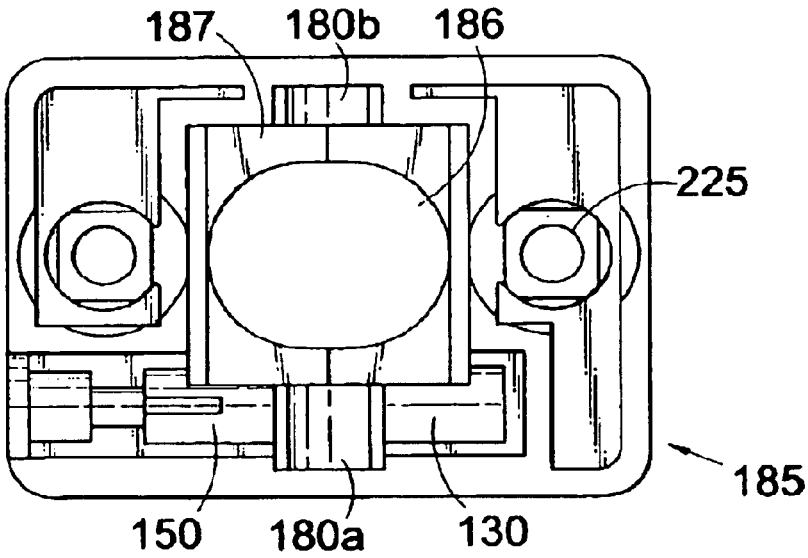
Figure 9:
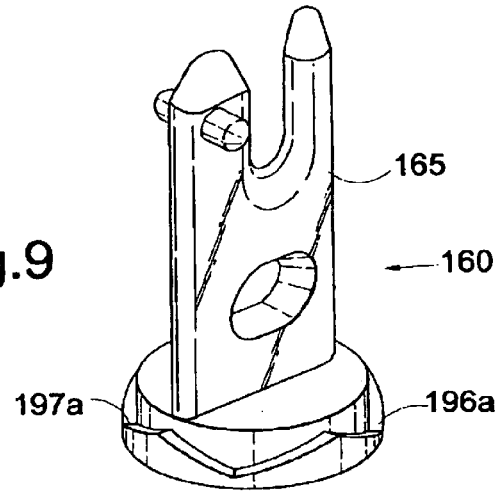
FIG. 9 a perspective view of a key portion of the operating key of FIG. 6.
Figure 10A:
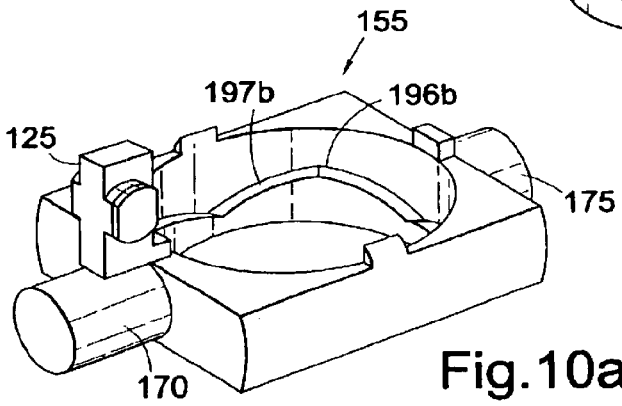
FIGS. 10*a* and 10*b* a perspective view from one side and a perspective view from an other side, respectively, of a swivel housing forming part of the operating key of FIG. 6.
Figure 10B:
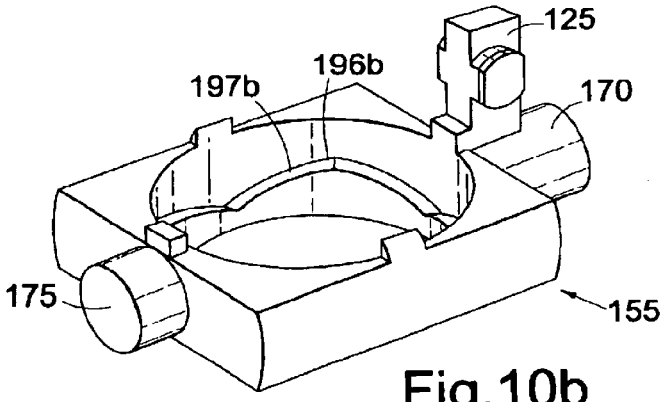
Figure 11A:
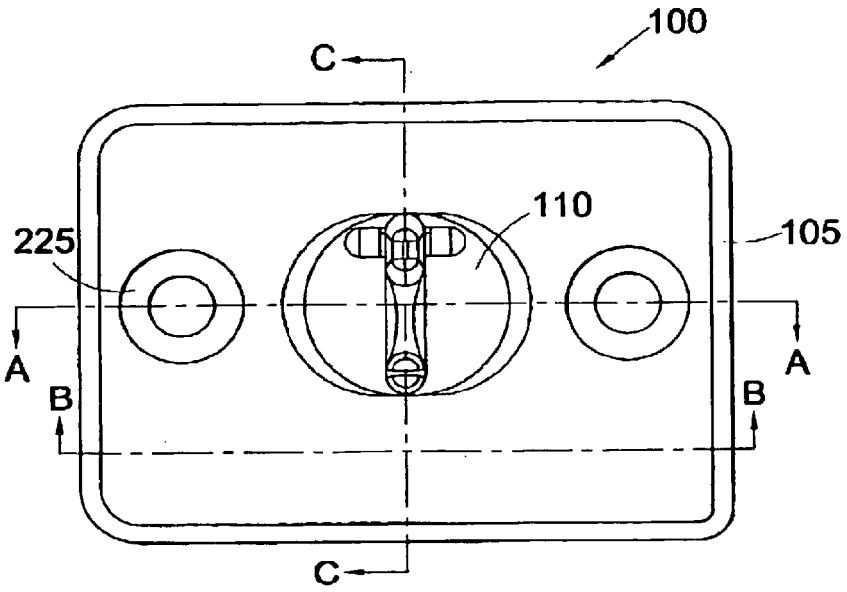
FIGS. 11*a*–11*d* a top view and a series of sectional side views of the operating key of FIG. 6.
Figure 11B:
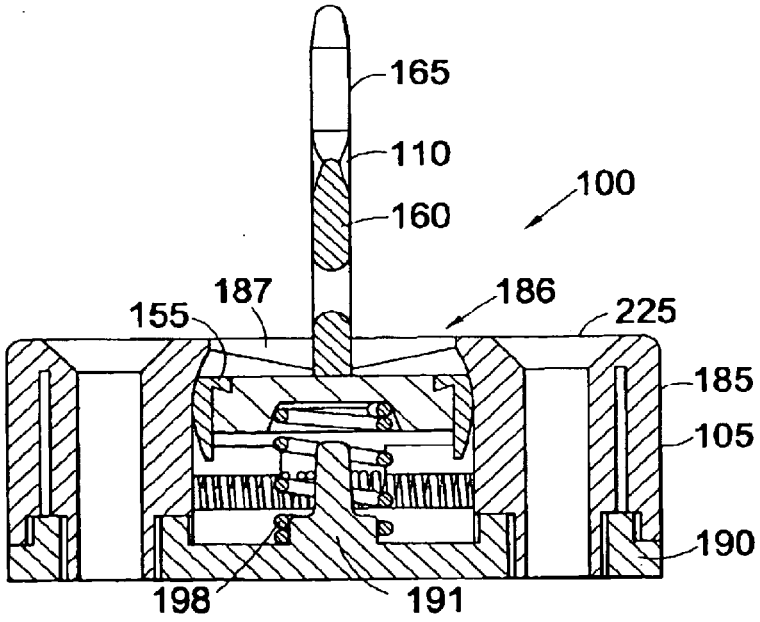
Figure 11C:
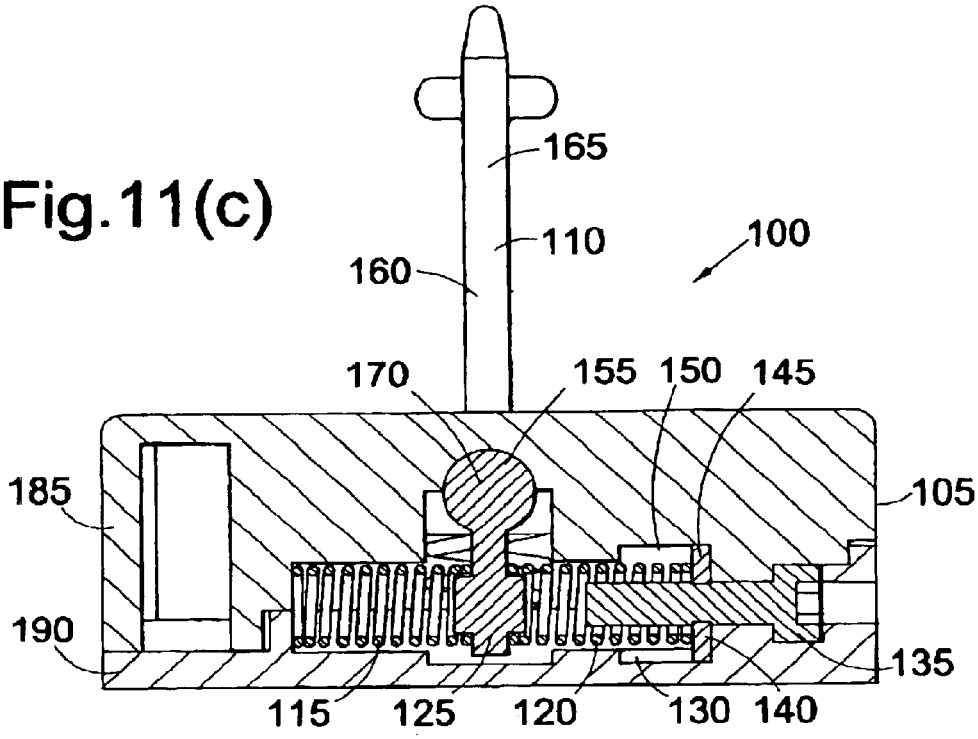
Figure 11D:
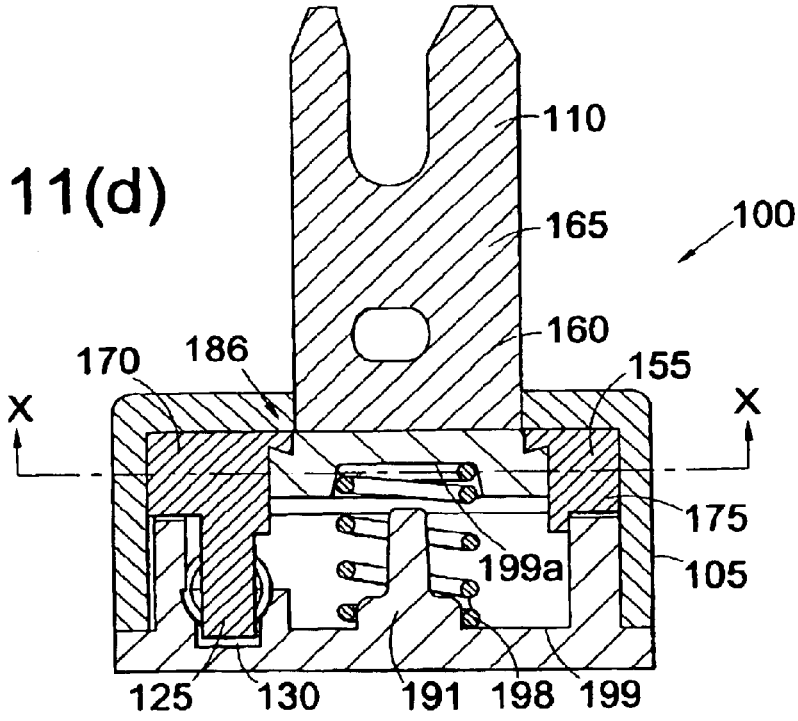
Figure 12:
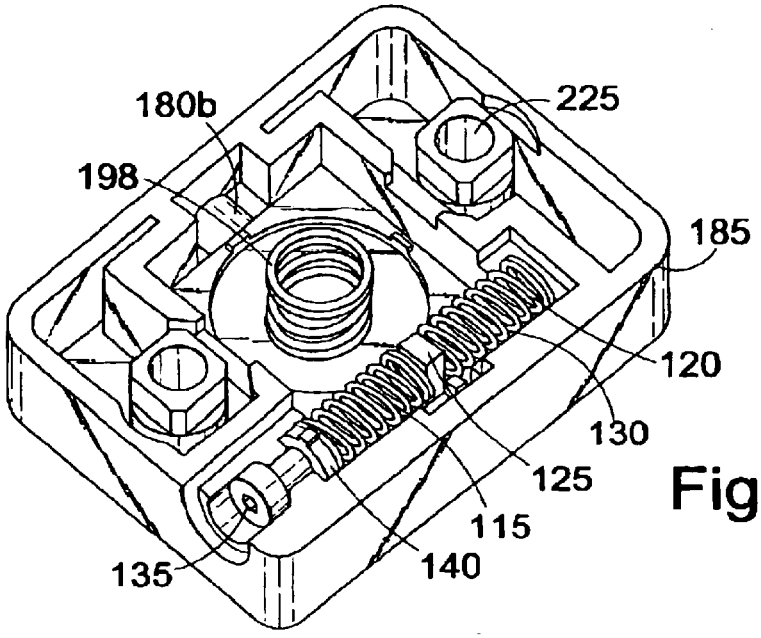
FIG. 12 a perspective view from below of the top portion of FIGS. 8*a* and 8*b* of the operating key of FIG. 6 in a partially assembled state.

Referring now to FIG. 5*b* there is shown a second adjustable key, generally designated 5*d*, for vertical radius pivot guards as known from the prior art. The key 5*d* is substantially identical to the key 5*c* hereinbefore described, like parts being identified by like numerals but suffixed with "d" rather than "c". However, as can be seen from FIG. 5*b* the operating key 5*d* differs from the operating key 5*c* in that the key portion 55*d* is rotated through 90° relative to the elongate portion 60*d*.

Referring now to FIGS. 6 to 13 there is illustrated an operating key, generally designated 100, according to an embodiment of the present invention. The operating key 100 is adapted for use in an actuator, the operating key 100 comprising a key body 105 and a key element 110 and means to adjust an angle of inclination of the key element 110 relative to the key body 105, the adjustment means having first and second resilient biasing means 115, 120.

The first and second resilient biasing means 115, 120 act to maintain the key element 110 in a first position while allowing the key element 110 to be resiliently moved to a second position relative to the key body 105. In this way the key element 110 is resiliently biassed between a first "set" position 'A', and a second "operating" position 'B'. See FIGS. 14 to 15. The first position A is a preset inclined position, and the second position B is normally perpendicular to the key body 105, and is the position which the key element 110 requires to adopt when inserted into a switch.

Figure 13:
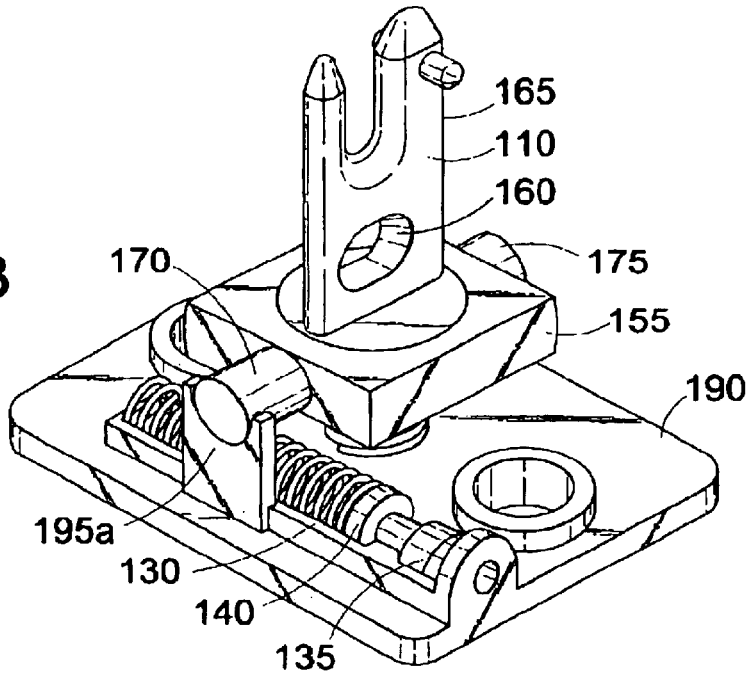
FIG. 13 a perspective view from above of a base portion and swivel housing and key portion of the operating key of FIG. 6 in a partially assembled state.

As can be seen from FIG. 13, the first and second resilient biasing means 115, 120 are substantially longitudinally aligned and spaced one from the other. In this embodiment the first and second resilient biasing means 115, 120 comprise first and second coiled springs.

The adjustment means further comprises a leg 125 depending from the key element 110. The leg 125 is received between adjacent ends of the first and second resilient biasing means 115, 120.

The adjustment means further includes means to adjust longitudinal tension of the first and second resilient biasing means 115, 120. The first and second resilient biasing means 115, 120 are provided within an elongate channel 130 in the key body 105.

The adjustment means further comprises and threaded adjustment screw 135 longitudinally retained relative to the channel 130 by means of co-acting shoulders 131*a*, 131*b*, 132, but free to rotate axially relative thereto, and a plate 140 carried on the threaded adjustment screw 135. A face of the plate 140 is in abutting contact with an end of one of the first or second resilient biasing means 115, 120.

There are also provided means for preventing rotatation of the plate 140 within the channel 130, which in this embodiment comprise co-acting nipples 145 and slots 150 formed on the plate 140 and in the channel 130 respectively.

In this way rotation of the adjustment of the adjustment screw 135 causes movement of the plate 140 therealong, thereby adjusting longitudinal tension of the first and second resilient biasing means 115, 120 so as to cause movement of the leg 125 and, therefore, of the key element 110. Thus the preset position A may be selected by rotation of the adjustment screw 135.

The key element 110 comprises a first body 155 and a second body 160 rotatably mounted on the first body 155. The second body 160 includes a key portion 165 insertable into a switch of the actuator.

The first body 155 comprises a swivel housing which carries first and second lugs 170, 175. The first lug 170 is held for rotation between a pair of first yokes 180*a*, 180*b* formed in a top portion 185 and in a base portion 190 of the key body 105. Similarly, the second lug 175 is held for rotation between a pair of second yokes 195*a*, 195*b* formed in the top portion 185 and the base portion 190.

In this way the key element 110 may be inclined relative to the key body 105 via the adjustment means.

The top portion 185 and base portion 190 are retained together by a friction fit prior to installation, and additionally by a fixing screw(s) clamping force after installation.

As can be seen from FIGS. 6 to 13, the key element 110 is held with the key body 105, and partially protrudes through an aperture 186 in the top portion 185. Further an inner surface 187 adjacent the aperture 186 is concave in shape so as to allow part rotation of the first body 155 about lugs 170, 175.

The operating key 5 further comprises means to at least partially rotate at least part of the key element around an axis 'X' extending from the key body 105.

In this embodiment, the axis X extends substantially perpendicularly from the key body 105, in a direction of insertion of the operating key 100 into a switch of the actuator.

The rotation means are adapted to allow 360° rotation of the key element 110 relative to the axis X in at least one direction of rotation and advantageously both directions of rotation.

The first body 155 is fixed relative to the axis X. However, as hereinbefore described the first body 155 comprises a swivel housing which can be partially rotated relative to a further axis parallel to the base portion 190 of the key body 105.

The rotation means comprise interengaging means such as teeth or typically known as an "90°" key grooves 196*a*, 196*b* formed in facing surfaces 197*a*, 197*b* of the first and second bodies 155, 160.

The interengaging means define 4 positions in which the first and second bodies 155, 160 may be located relative to one another. In this way the first body may be rotated relative to the second body 160 by 90° increments.

The first and second bodies 155, 160 are urged together by further resilient biassing means, such as a coiled spring 198. The further resilient biassing means 198 are provided between facing surfaces 199*a*, 199*b* of the second body 160 and the base portion 190 on an upstanding portion 191 formed on the surface 199*b* of the base portion 190.

In use, the second body 160 may be depressed by a user against a biassing force of the further biassing means 198, thereby disengaging the interengaging means on the first and second bodies 155, 160. The first and second bodies 155, 160 may then be rotated relative to one another from one set position to another set position. The user may then cease depression of the second body 160 thereby re-engaging the engaging means.

The key body 105 comprising top portion 185 and base portion 190 may be made from a glass filled polyamide and may be coloured black. Further the first body 155 of the key element 110 may also be made from a glass filled polyamide and may also be coloured black. The second body 160 of the key element 110 may be made from, for example, stainless steel.

Figure 14:
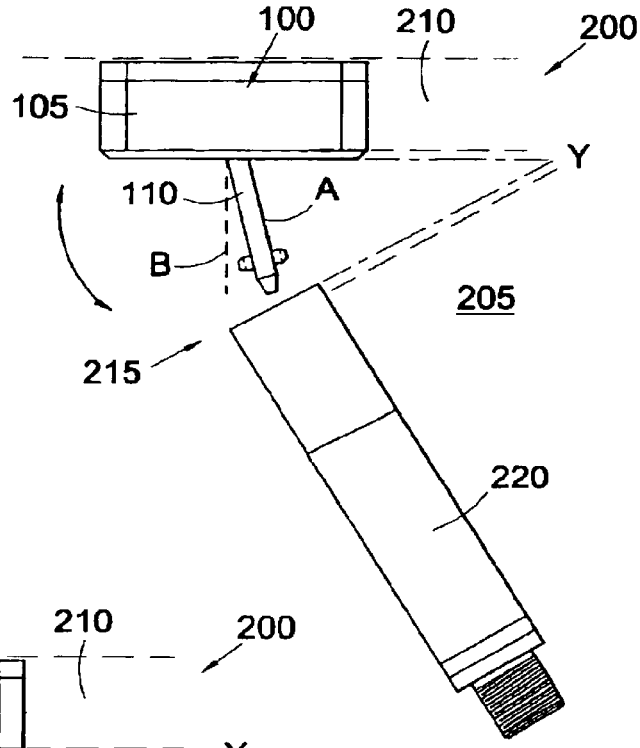
FIG. 14 an actuator including a switch and an operating key according to FIG. 6, in use, in a first orientation.

Referring to FIG. 14 there is shown an apparatus, generally designated 200, including a casing 205 and a door 210 hingably connected to the casing. The apparatus 200 includes an actuator 215 comprising a switch 220 and an operating key 100 according to the present invention. As can be seen from FIG. 14 the switch 220 is mounted on the casing 205, while the operating key 100 is mounted on the door 210 by means of screws or the like acceptable within apertures 225 formed through the key body 105. It will, however, be appreciated that the switch 220 may be conveniently mounted on the door 210 and the operating key 100 mounted on the casing 205 if desired for a particular application.

As can be seen from FIG. 14 the key element 110 is rotated so as to be in a plane sharing a common longitudinal axis with an aperture of the switch 220. Further the key element 110 is inclined at a preset angle to the perpendicular from a base of the key body 105, that is in position A.

In use, as the door 210 is closed the operating key 100 moves towards the switch 220 and the key element 110 is partially received into an aperture of the switch 220. As the door 210 is further closed towards the casing 205, the key element 110 is urged from the first position A towards the second position B so as to be received within the aperture of the actuator 215.

When the door 210 is opened the key element 110 is released from the aperture and, therefore, moves from the second position B to the first position A under influence of the first and second resilient biassing means 115, 120.

The arrangement shown in FIG. 14 is of particular use in horizontal hinged doors.

Figure 15:
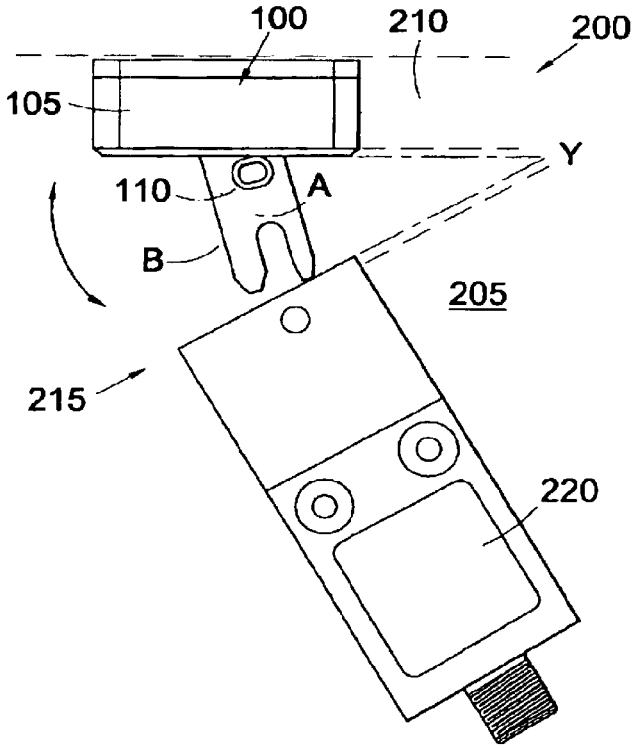
FIG. 15 the actuator of FIG. 14, in use, in a second orientation.

Shown in FIG. 15 is a second arrangement of particular use in vertical hinged doors. In this second arrangement the key element 110 and the aperture of the switch 220 are provided on a common plane substantially perpendicular to an axis Y of the hinge of the door 210.

In the first and second arrangements of FIGS. 14 and 15 it is envisaged that an operating radius of the actuator 215 may be in the region of 50 mm or less. This is a significant improvement over prior actuators.

It will be appreciated that the embodiment of the invention hereinbefore described is given by way of example only, and is not meant to limit the scope thereof in any way.

In particular, it will be appreciated that the shape and/or size of the key element may vary. For example, the shape of the key element may be substantially the same as the prior art key element shown in FIGS. 1 and 2 or FIG. 5*a* or 5*b*.

It will further be appreciated that the first and second resilient biassing means may be other than first and second coiled springs. In essence all that is required are two opposed resilient sprung components against the leg 125 of the swivel housing, in order that it is allowed to move between a set angled position and a perpendicular position relative to an insertion face of the switch. Thus sprung components such as torsion or leaf springs may be used.

Further, although the specific embodiment hereinbefore described includes an adjustment screw in a side of the key body, the adjustment screw could be provided in other faces of the key body by suitably changing the interface at the leg of the swivel housing.

Further, the further resilient biassing means may be other than a coiled spring.

Further, although the specific embodiment hereinbefore described provides for 90° increments of rotation of the key element, different rotational increments could be provided for by suitable modification of the operating key.

What is claimed is:

1. An operating key for use in an actuator, the operating key comprising a key body and a key element and means to adjust an angle of inclination of the key element relative to the key body, the adjustment means having first and second resilient biasing means, wherein the adjustment means further comprises a leg depending from the key element, wherein the adjustment means further comprises a threaded adjustment screw longitudinally retained relative to the channel but free to rotate axially relative thereto, and a plate carried on the threaded adjustment screw.

2. An operating key as claimed in claim 1, wherein the first and second resilient biasing means act to maintain the key element in a first position, while allowing the key element to be resiliently moved to a second position relative to the key body.

3. An operating key as claimed in claim 2, wherein the first position is a preset inclined position relative to the key body, and the second position.

4. An operating key as claimed in claim 1, wherein the first and second resilient biasing means act against opposing sides of a portion of the key element.

5. An operating key as claimed in claim 1, wherein the first and second resilient biasing means are substantially longitudinally aligned and spaced one from the other.

6. An operating key as claimed in claim 1, wherein the first and second resilient biasing means comprise first and second coiled springs.

7. An operating key as claimed in claim 1, wherein the adjustment means further comprises a leg depending from the key element.

8. An operating key as claimed in claim 7, wherein the leg is received between adjacent ends of the first and second resilient biasing means.

9. An operating key as claimed in claim 1, wherein the adjustment means further includes means to adjust longitudinal tension of the first and second resilient biasing means.

10. An operating key as claimed in claim 1, wherein the first and second resilient biasing means are provided within an elongate channel in the key body.

11. An operating key as claimed in claim 1, wherein the key element comprises a first body and a second body rotatably mounted on the first body.

12. An operating key for use in an actuator, the operating key comprising:

a key body and a key element;

means to adjust an angle of inclination of the key element relative to the key body, the adjustment means having first and second resilient biasing means, wherein the adjustment means further comprises a leg depending from the key element, wherein the adjustment means further comprises a threaded adjustment screw longitudinally retained relative to the channel but free to rotate axially relative thereto, and a plate carried on the threaded adjustment screw;

wherein a face of the plate is in abutting contact with an end of one of the first or second resilient biasing means;

wherein there are provided means for preventing rotation of the plate within the channel; and wherein rotation of the adjustment screw causes movement of the plate therealong thereby adjusting longitudinal tension of the first and second resilient biasing means so as to cause movement of the leg and therefore of the key element.

13. An operating key for use in an actuator, the operating key comprising:

a key body and a key element;

means to adjust an angle of inclination of the key element relative to the key body, the adjustment means having first and second resilient biasing means, wherein the adjustment means further comprises a leg depending from the key element, wherein the adjustment means further comprises a threaded adjustment screw longitudinally retained relative to the channel but free to rotate axially relative thereto, and a plate carried on the threaded adjustment screw, wherein a face of the plate is in abutting contact with an end of one of the first or second resilient biasing means.

14. An operating key for use in an actuator, the operating key comprising:

a key body and a key element;

means to adjust an angle of inclination of the key element relative to the key body, the adjustment means having first and second resilient biasing means, wherein the adjustment means further comprises a leg depending from the key element, wherein the adjustment means further comprises a threaded adjustment screw longitudinally retained relative to the channel but free to rotate axially relative thereto, and a plate carried on the threaded adjustment screw, wherein there are provided means for preventing rotation of the plate within the channel.

15. An operating key for use in an actuator, the operating key comprising:

a key body and a key element;

means to adjust an angle of inclination of the key element relative to the key body, the adjustment means having first and second resilient biasing means, wherein the adjustment means further comprises a leg depending from the key element, wherein the adjustment means further comprises a threaded adjustment screw longitudinally retained relative to the channel but free to rotate axially relative thereto, and a plate carried on the threaded adjustment screw, wherein rotation on the adjustment screw causes movement of the plate therealong thereby adjusting longitudinal tension of the first and second resilient biasing means so as to cause movement of the leg and therefore of the key element.

* * * * *